US010176937B2

(12) United States Patent
Lettow et al.

(10) Patent No.: US 10,176,937 B2
(45) Date of Patent: Jan. 8, 2019

(54) ELECTRICAL SWITCHES AND SENSORS

(71) Applicant: VORBECK MATERIALS CORP., Jessup, MD (US)

(72) Inventors: John S Lettow, Washington, DC (US); Terumi N McKenna, Laurel, MD (US); Dan F Scheffer, Frederick, MD (US)

( * ) Notice: Subject to any disclaimer, the term of this patent is extended or adjusted under 35 U.S.C. 154(b) by 66 days.

(21) Appl. No.: 15/037,481

(22) PCT Filed: Sep. 4, 2014

(86) PCT No.: PCT/US2014/054165
§ 371 (c)(1),
(2) Date: May 18, 2016

(87) PCT Pub. No.: WO2015/035103
PCT Pub. Date: Mar. 12, 2015

(65) Prior Publication Data

US 2016/0300669 A1 Oct. 13, 2016

Related U.S. Application Data

(60) Provisional application No. 61/873,019, filed on Sep. 3, 2013.

(51) Int. Cl.
*H01H 1/029* (2006.01)

(52) U.S. Cl.
CPC ..... *H01H 1/029* (2013.01); *H01H 2201/036* (2013.01); *H01H 2300/036* (2013.01)

(58) Field of Classification Search
CPC .. H01H 1/029; H01H 35/26; H01H 2201/036; H01H 2300/036
USPC ..... 338/100; 200/81 R, 511
See application file for complete search history.

(56) References Cited

U.S. PATENT DOCUMENTS 4,489,302 A * 12/1984 Eventoff ..... B60C 23/0408 338/100
4,745,301 A * 5/1988 Michalchik ..... H01B 1/24 252/511
4,790,968 A * 12/1988 Ohkawa ..... H01C 10/106 200/264
2011/0051775 A1* 3/2011 Ivanov ..... B82Y 30/00 374/143
2011/0088931 A1* 4/2011 Lettow ..... B82Y 30/00 174/257

(Continued)

OTHER PUBLICATIONS

Milaninia K.M., All Graphene Electrochemical Switch Fabricated by Chemical Vapor Deposition, App. Phys. L. 95, 183105 (2009).

(Continued)

*Primary Examiner* — Renee S Luebke
*Assistant Examiner* — Iman Malakooti
(74) *Attorney, Agent, or Firm* — Trentice V. Bolar, Esq.

(57) ABSTRACT

Electrical switches or sensors that comprise (a) a first electrical pole, (b) a layer of a variable resistance material in electrical contact with the first electrical pole, and (c) a second electrical pole that is in electrical contact with the variable resistance material and is not in electrical contact with the first pole, wherein the variable resistance material comprises at least one polymer having a glass transition temperature of no higher than about 10° C.

17 Claims, 3 Drawing Sheets

(56) References Cited

U.S. PATENT DOCUMENTS

| | | | | |
|---|---|---|---|---|
| 2011/0186786 | A1* | 8/2011 | Scheffer | H01B 1/24 252/510 |
| 2011/0198556 | A1 | 8/2011 | Yamamoto | |
| 2011/0221564 | A1* | 9/2011 | Deppiesse | H03K 17/965 338/99 |
| 2011/0221654 | A1 | 9/2011 | Deppiesse | |
| 2012/0073948 | A1* | 3/2012 | Hurst | H01H 35/26 200/81 R |

OTHER PUBLICATIONS

Kalpakjian, "Glass Transition Temperature" Manufacturing Processes for Engineering Materials, 5th ed. 2008 (2008), p. 1.

* cited by examiner

ELECTRICAL SWITCHES AND SENSORS

FIELD OF THE INVENTION

The present invention relates to pressure sensitive electrical switches and sensors comprising at variable resistance material.

BACKGROUND

Many electrical switches or sensors have a moveable electrically conductive element that is coupled to one pole of the switch and that can be moved through space to mechanically contact another pole of the switch to close a circuit. Such devices can be complex to manufacture and the mechanical elements require space in which to operate. It would be desirable to obtain a switch or sensor that can respond to an applied force but that does not require the use of a moveable electrically conductive element.

SUMMARY OF THE INVENTION

Disclosed and claimed here are electrical or electronic switches or sensors, comprising:

(a) a first electrical pole, (b) a layer of a variable resistance material in electrical contact with the first electrical pole, and (c) a second electrical pole that is in electrical contact with the variable resistance material and is not in electrical contact with the first pole, wherein the variable resistance material comprises at least one polymer having a glass transition temperature of no higher than about 10° C.

DETAILED DESCRIPTION OF THE INVENTION

The switch or sensor comprises at least two electrically conductive poles that are separated from each other by a layer of a variable resistance material. Each pole is in electrical contact with the variable resistance material. The resistance of the variable resistance material varies as a function of the force applied to the variable resistance material. When a force is applied to the variable resistance material, in some cases in a direction that is generally perpendicular to the surface layer of the variable resistance material, the resistance of the variable resistance material decreases and electrical current flow between the poles increases. The resistance of the layer of the variable resistance material is sufficient to substantially block electrical current flow through the layer when no force is applied (the switch or sensor circuit is open). When a sufficiently strong force is applied to the layer, the switch or sensor circuit is closed and the variable resistance material has reduced electrical resistance and will conduct an electrical current.

Figure 1A:
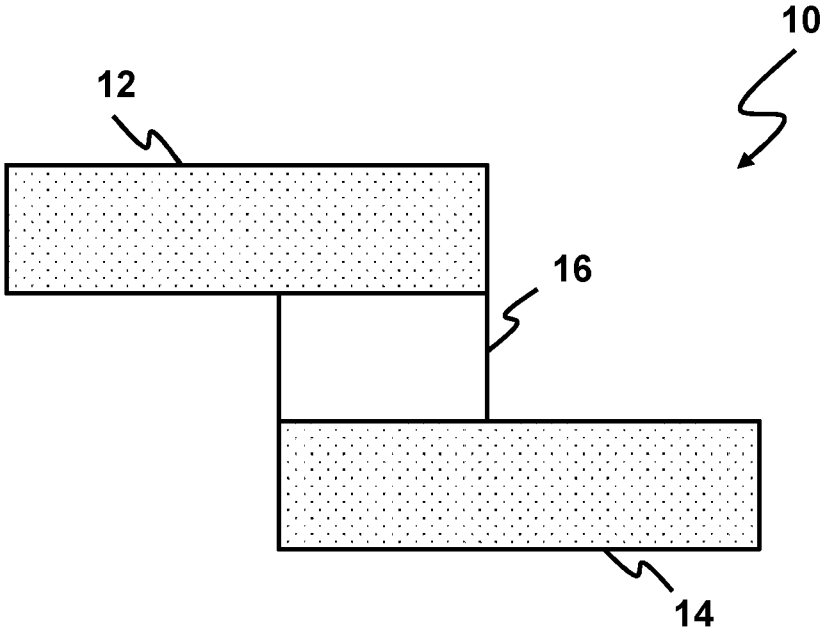
FIG. 1*a* is a schematic cross-sectional view of a switch or sensor where no force is applied to the variable resistance material layer.
Figure 1B:
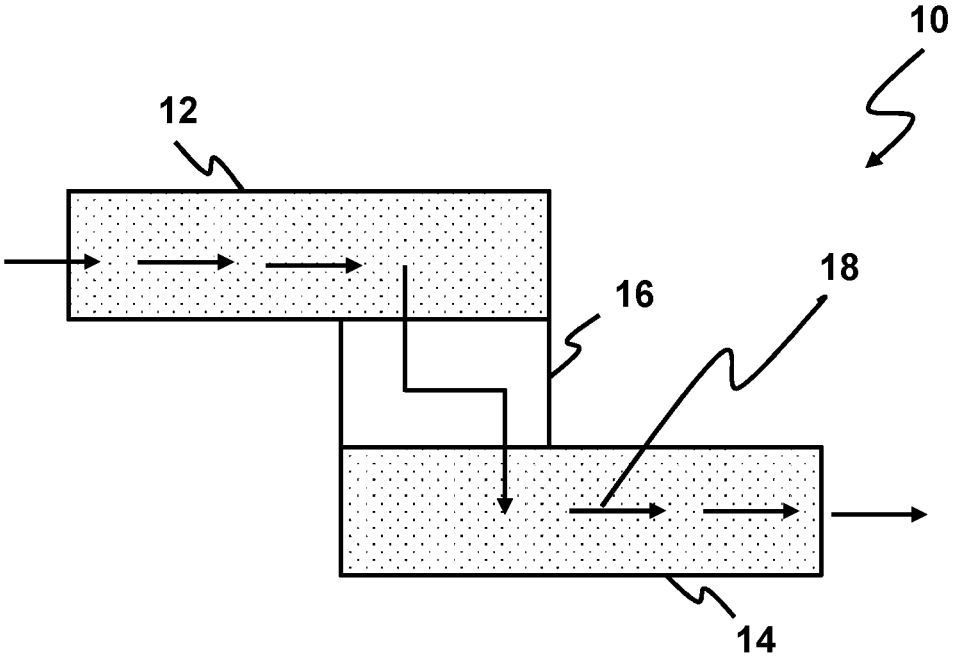
FIG. 1*b* is a schematic cross-sectional view of a switch or sensor where a force is applied to the variable resistance material layer.

FIG. 1*a* shows a switch or sensor 10 having a first electrically conductive pole 12 and a second electrically conductive pole 14 that are separated from each other by a layer 16 of a variable resistance material. FIG. 1*b* shows the same switch or sensor 10 where a sufficient force/pressure is applied to the general area of the variable resistance material 16 to lower the resistance between the poles to the amount necessary to activate the switch or sensor and permit electrons to flow between poles 12 and 14, as indicated by the arrows 18.

Figure 2:
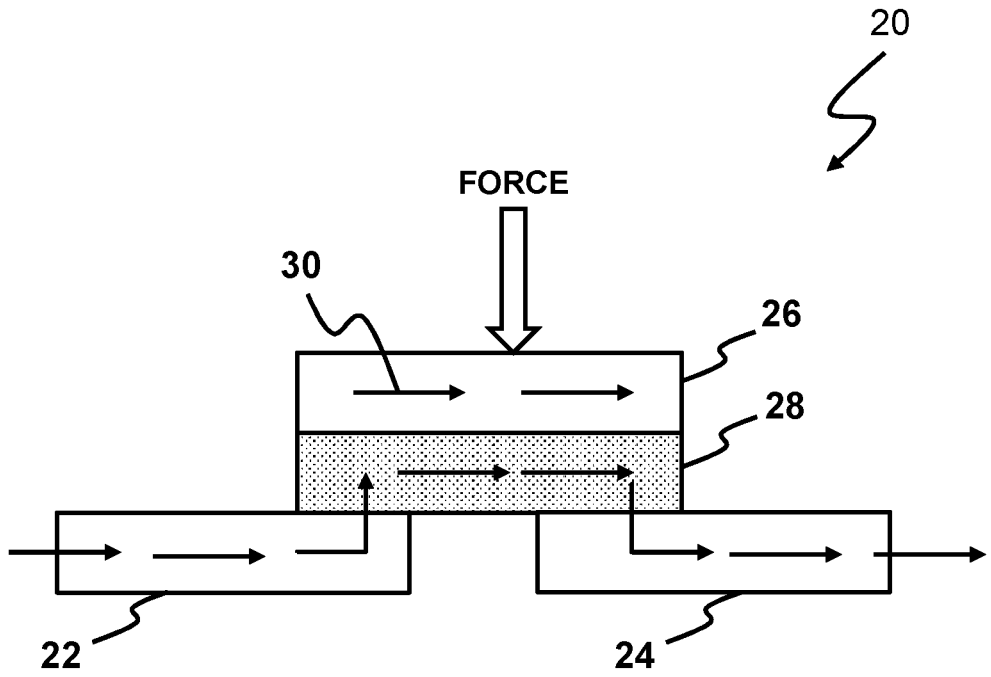
FIG. 2 is a schematic cross-sectional view of a switch or sensor having an additional conductive element linking the poles.

There may be an additional conductive pathway in contact with the variable resistance material that is positioned between the poles. FIG. 2 shows a switch or sensor 20 having poles 22 and 24 over which is applied a layer 28 of variable resistance material that separates the poles from an upper conductive material 26. When sufficient force is applied to the variable resistance material, electrical current can flow between poles 22 and 24 through the variable resistance material and upper conductive material, as indicated by the arrows 30.

Figure 3:
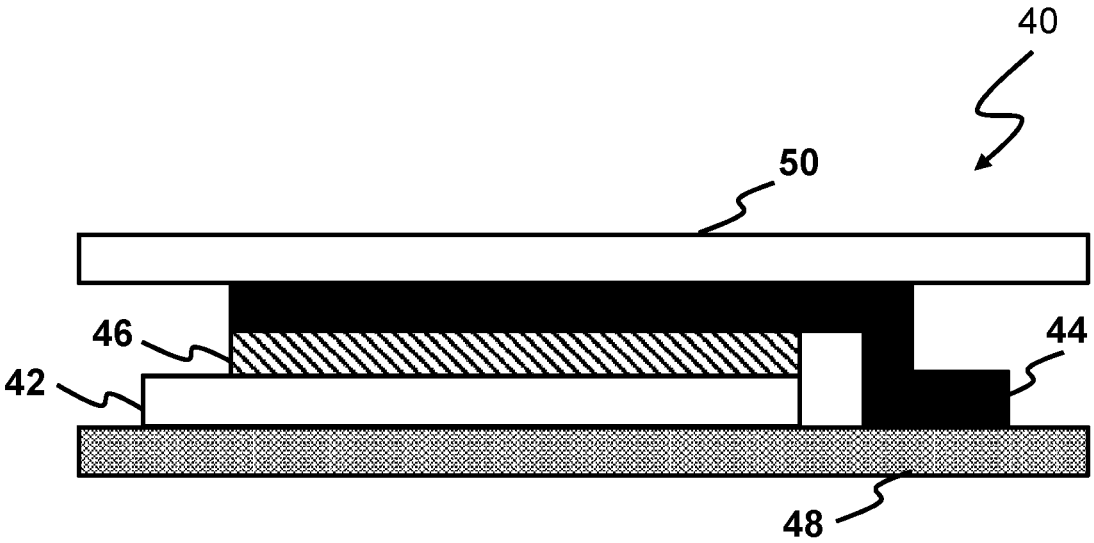
FIG. 3 is a schematic cross-sectional view of a switch or sensor wherein the poles are applied to a substrate.

One or more of the poles may be deposited or adhered to a non-conductive substrate. For example, FIG. 3 shows a switch or sensor 40 with a non-conductive substrate 48 on which is applied poles 42 and 44, which are separated by variable resistance material 46. The switch or sensor is further covered by non-conductive layer 50.

Figure 4:
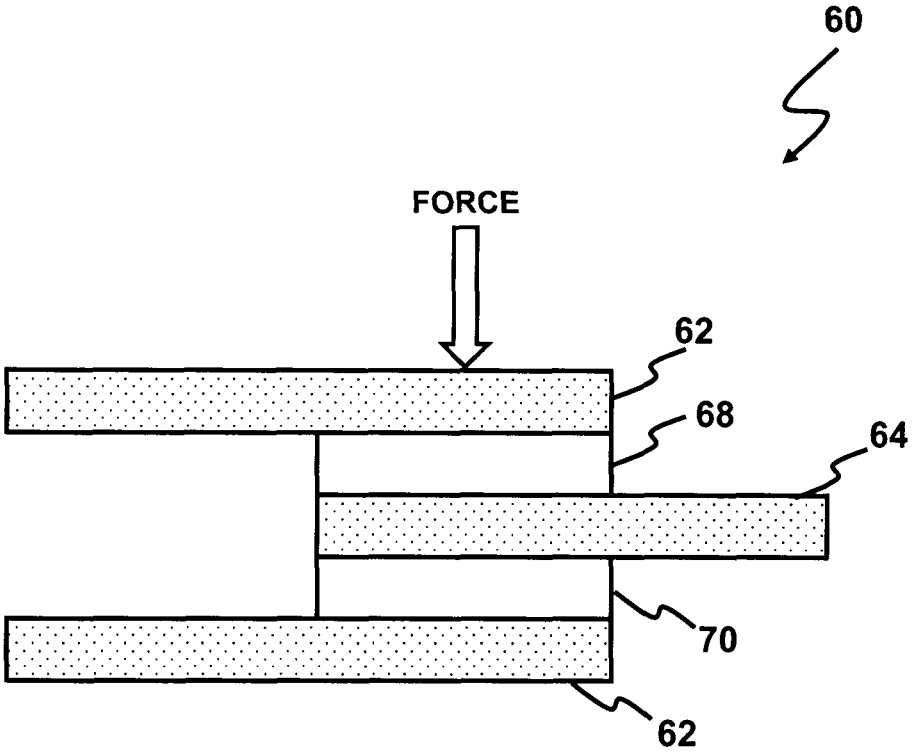
FIG. 4 is a schematic cross-sectional view of a switch or sensor having three poles separated by variable resistance material layers.

In some cases, the switch or sensor may comprise multiple layers. For example, FIG. 4 shows a switch or sensor 60 having a first electrically conductive pole 62 and a second electrically conductive pole 64 separated by a layer 70 of variable resistance material. Pole 64 is in turn separated from third electrically conductive pole 66 by a layer 68 of variable resistance material. In some cases, when a force is applied to the switch or sensor, the electrical resistances between poles 66 and 64, poles 66 and 62, and/or poles 64 and 62 can be the same or different. Differences in electrical resistances can be tuned by adjusting the thicknesses and/or conductivities of the poles and/or variable resistance layers, the forces applied, etc.

The poles (and any additional conductive pathways between them) can be made of any suitable electrically conductive material. They can be metals or metal alloys (e.g. copper, aluminum, silver, gold, etc.), organic, polymeric, and/or carbon-based conductors etc., coatings or inks, etc. Conductive material can be in any suitable form, including strips, sheets, foils, tapes, wires, threads, etc. Conductive materials can be deposited, such as by sputtering, plating, etching, molding, printing, coating, metallization, vapor deposition or other deposition techniques. The poles can be adhered to a non-conductive substrate by direct application, via an adhesive, etc. The poles and variable resistance layer can be in direct (such as intimate) contact or electrically connected via an electrically conductive intermediary, such as a conductive adhesive, or a non-conductive intermediary.

One or more of the poles can be applied to the variable resistance layer or the variable resistance layer can be applied to the poles. Any suitable technique can be used to apply the poles to the variable resistance layer or vice versa, including printing or coating, adhesion via a electrically conductive adhesive, molding, etc.

The variable resistance material comprises at least one low-glass transition temperature polymer having a glass transition temperature (Tg) that is no higher than about 10° C., or no higher than about 5° C., or no higher than about 0° C., or no higher than about −5° C., or no higher than about −10° C., or no higher than about −15° C., or no higher than about −20° C., or no higher than about −25° C., or no higher than about −30° C. In some cases, the variable resistance material is a pressure-sensitive adhesive. One method of measuring glass transition temperatures uses differential scanning calorimetry (DSC) following ASTM method D3418-82 (Reapproved 1988).

Examples of polymers include thermoplastic and thermosetting/crosslinked polymers, polyurethanes, acrylate-based polymers, such as polyacrylate, poly(methacrylates) (such as poly(methyl methacrylate) (PMMA), poly(acrylic acids), polycyanoacrylates, polyacrylamides, etc. Examples include polymers of one or more of methyl methacrylate, ethyl methacrylate, acrylic acid, acrylonitrile, acrylic acid alkylesters (such as ethyl or butyl esters), methyl acrylate, ethyl acrylate, 2-chloroethyl vinyl ether, 2-ethylhexyl acrylate, hydroxyethyl methacrylate, butyl acrylate, butyl methacrylate, TMPTA (trimethylolpropane triacrylate), cyanoacrylate, vinyl acetate, acrylic acid, vinyl acetate and acrylic acid (PVAc), acrylamides, etc. Examples include polyolefins, such as polyethylenes (such as low-density polyethylene (LDPE), polypropylenes (such as atactic polypropylene), fluoropolymers (such as poly(vinylidene fluoride) (PVDF), poly(vinyl fluoride) (PVF), etc.), rubbers and elastomers (such as polybutadiene, styrene-butadiene rubber (SBR), etc.). Polymers can include pressure sensitive polymers adhesives (such as pressure-sensitive acrylate-based polymers) and materials that are tacky at the temperature at which the switch or sensor is used.

The variable resistance material may contain conductive or semiconductive components, such as those listed below for use with electrically conductive inks or coatings. The conductive components can be in the form of conductive particles or semiconductive particles. The conductive components can be, for example, metals, carbon, or organic conductors or inorganic or organic semiconductors. In some cases, the conductive particles have a D90 particle size of no more than about 1 nm, or about 10 nm, or about 100 nm, or about 1 micron, or about 10 microns, or about 100 microns, or about 1 mm. Particle size can be measured using any suitable method, such as light scattering.

In some cases, the conductive components can be present in about 0.001 to about 40 weight percent, or about 0.001 to about 30 weight percent, or about 0.001 to about 20 weight percent, or about 0.001 to about 10 weight percent, or about 0.001 to about 5 weight percent, or about 0.001 to about 2 weight percent, or about 0.001 to about 1 weight percent, or about 0.001 to about 0.5 weight percent, or about 0.001 to about 0.1 weight percent, or about 0.001 to about 0.01 weight percent, or about 0.01 to about 40 weight percent, or about 0.01 to about 30 weight percent, or about 0.01 to about 20 weight percent, or about 0.01 to about 10 weight percent, or about 0.01 to about 5 weight percent, or about 0.01 to about 2 weight percent, or about 0.01 to about 1 weight percent, or about 0.01 to about 0.5 weight percent, or about 0.01 to about 0.1 weight percent, or about 0.1 to about 40 weight percent, or about 0.1 to about 30 weight percent, or about 0.1 to about 20 weight percent, or about 0.1 to about 10 weight percent, or about 0.1 to about 5 weight percent, or about 0.1 to about 2 weight percent, or about 0.1 to about 1 weight percent, or about 0.1 to about 0.5 weight percent, or about 0.5 to about 40 weight percent, or about 0.5 to about 30 weight percent, or about 0.5 to about 20 weight percent, or about 0.5 to about 10 weight percent, or about 0.5 to about 5 weight percent, or about 0.5 to about 2 weight percent, or about 0.5 to about 1 weight percent, or about 1 to about 40 weight percent, or about 1 to about 30 weight percent, or about 1 to about 20 weight percent, or about 1 to about 10 weight percent, or about 1 to about 5 weight percent, or about 1 to about 2 weight percent, or about 2 to about 40 weight percent, or about 2 to about 30 weight percent, or about 2 to about 20 weight percent, or about 2 to about 10 weight percent, or about 2 to about 5 weight percent, or about 5 to about 40 weight percent, or about 5 to about 30 weight percent, or about 5 to about 20 weight percent, or about 5 to about 10 weight percent, or about 10 to about 40 weight percent, or about 10 to about 30 weight percent, or about 10 to about 20 weight percent, or about 20 to about 40 weight percent, or about 20 to about 30 weight percent, wherein the weight percentages are based on the total weight of the conductive components and the low Tg polymer.

The variable resistance material can comprise additional components, such as tackifiers, rheology modifiers, shear thickeners, pigments, dyes, fillers, reinforcing agents, minerals, plasticizers, surfactants, wetting and dispersing additives, etc.

The variable resistance material layer may be in the form of an ink or coating that is applied to one or more poles and/or one or more intervening conductive elements. One or more poles and/or one or more intervening conductive elements can be applied to the variable resistance material. For example, a pole may be applied to a substrate (such as by printing) and the variable resistance layer may be coated or printed onto the pole. One or more additional poles may then be applied to the variable resistance layer such as by overprinting, coating, plating, etching, sputtering, deposition, vapor deposition, metallization, conductive adhesive, etc.

The poles can be conducted to electrical or electronic circuits. The sensors can be used to detect applied force or pressure. They can be used to detect that a pressure is applied or that a specific pressure is applied.

The variable resistance material layer may be applied as an ink or coating. The ink or coating can comprise solvents, pigments, dyes, fillers, reinforcing agents, minerals, wetting and dispersing additives, rheology modifiers, shear thickeners, surfactants, wetting and dispersing additives, plasticizers, tackifiers, etc. in addition to the low-Tg polymer. The variable resistance layer may also be applied in other forms, for example, as a sheet via lamination, as a die-cut label etc.

In some cases, the resistance between two poles of the switch or sensor without a force being applied is at least about 10Ω, 100Ω, or 1000Ω, or 10 kΩ, or 100 kΩ, or at least about 500 kΩ, or at least about 1 MΩ, or at least about 10 MΩ, or at least about 100 MΩ, or at least about 10,000 MO.

In some cases, when a force is applied, the resistance drops to no more than about 500 kΩ, no more than about 250 kΩ, no more than about 100 kΩ, no more than about 50 kΩ, no more than about 10 kΩ, no more than about 5 kΩ, no more than about 1 kΩ, no more than about 500Ω, no more than about 250Ω, no more than about 100Ω, no more than about 50Ω, no more than about 10Ω, no more than about 1Ω, no more than about 0.1Ω, or no more than about 0.01Ω.

In some cases, the resistance drops from at least about 1 MΩ to no more than about 1 kΩ, or from at least about 1 MΩ to no more than about 500Ω, or from at least about 1 MΩ to no more than about 100Ω, or from at least about 1 MΩ to no more than about 50Ω, or from at least about 1 MΩ to no more than about 10Ω, from at least about 1 MΩ to no more than about 1Ω when a force is applied.

In some cases, the difference in the resistance between two poles of the switch or sensor drops from that without a force being applied to that with a force being applied by a factor of at least about 10, or a factor of at least about 50, or a factor of at least about 100, or a factor of at least about 500, or a factor of at least about 1000, or a factor of at least about 5000, or a factor of at least about 10,000, or a factor of at least about 50,000, or a factor of at least about 100,000, or a factor of at least about 500,000, or a factor of at least about 1,000,000, or a factor of at least about 5,000,000, or a factor of at least about 10,000,000, or a factor of at least about 50,000,000, or a factor of at least about 100,000,000, or a factor of at least about 500,000,000, or a factor of at least about 1,000,000,000.

In some cases, the difference in resistance can be between a factor of at least about 10 to at least about 100,000,000, or between a factor of about at least about 10 to at least about 10,000,000, or between a factor of about at least about 10 to at least about 1,000,000, or between a factor of about at least about 10 to at least about 100,000, or between a factor of about at least about 10 to at least about 10,000, or between a factor of about at least about 10 to at least about 1,000, or between a factor of about at least about 10 to at least about 100, or between a factor of at least about 100 to at least about 100,000,000, or between a factor of about at least about 100 to at least about 10,000,000, or at least about 100 to at least about 1,000,000, or between a factor of about at least about 100 to at least about 100,000, or between a factor of about at least about 100 to at least about 10,000, or between a factor of about at least about 100 to at least about 1,000, or between a factor of at least about 1,000 to at least about 1,000,000, or between a factor of at least about 1,000 to at least about 100,000,000, or between a factor of about at least about 1,000 to at least about 10,000,000, or between a factor of at least about 1,000 to at least about 1,000,000, or between a factor of about at least about 1,000 to at least about 100,000, or between a factor of about at least about 1,000 to at least about 10,000, or between a factor of at least about 10,000 to at least about 100,000,000, or between a factor of about at least about 10,000 to at least about 10,000,000, or between a factor of at least about 10,000 to at least about 1,000,000, or between a factor of about at least about 10,000 to at least about 100,000.

In some cases, the resistance between the poles may drop sharply when a force is applied. In other cases, the resistance can vary gradually based on the magnitude of the force. In some such cases, the switch or sensor can function as a potentiometer, where the current flow through the switch or sensor varies as a function of force applied to the variable resistance material.

A force may be applied to the switch or sensor using any appropriate means, such as a finger, thumb, or other body part or digit, a stylus, or the like. The thickness of the poles and/or the variable resistance material layer can be adjusted to give different resistance difference ranges and forces required to operate the switch or sensor. Different thickness of poles and/or the variable resistance material layer can be used for different layers when more than one layer is used.

In some cases, the thickness of the variable resistance layer can be at least about 100 nm, or at least about 500 nm, or at least about 1 micron, or at least about 10 microns, or at least about 50 microns, or at least about 100 microns, or at least about 200 microns, or at least about 400 microns, or at least about 500 microns, or at least about 600 microns, or at least about 800 microns, or at least about 1 mm, or no more than about 800 microns, or no more than about 400 microns, or no more than about 300 microns, or no more than about 200 microns, or no more than about 100 microns, or no more than about 50 microns, or no more than about 10 microns. In some cases, the thickness can be between about 100 nm and about 500 microns, or between about 500 nm and about 500 microns, or between about 1 micron and about 500 microns, or between about 10 microns and about 500 microns, or between about 50 microns and about 500 microns, or between about 100 microns and about 500 microns, or between about 200 microns and about 500 microns, or between about 100 nm and about 250 microns, or between about 500 nm and about 250 microns, or between about 1 micron and about 250 microns, or between about 10 microns and about 250 microns, or between about 50 microns and about 250 microns, or between about 100 microns and about 250 microns, or between about 200 microns and about 250 microns or between about 100 nm and about 100 microns, or between about 500 nm and about 100 microns, or between about 1 micron and about 100 microns, or between about 10 microns and about 100 microns, or between about 50 microns and about 100 microns, or between about 100 microns and about 100 microns, or between about 200 microns and about 100 microns.

In some cases, the force used is at least about 0.01 N, or at least about 0.1 N, or at least about 0.5 N, or at least about 1 N, or at least about 2 N, or at least about 4 N, or at least about 6 N, or at least about 8 N, or at least about 10 N, or at least about 12 N, or at least about 15 N, or at least about 20 N, or at least about 30 N. In some cases, the force used is between about 0.01 N and about 30 N, or between about 0.01 N and about 20 N, or between about 0.01 N and about 10 N, or between about 0.01 N and about 6 N, or between about 0.01 N and about 2 N, or between about 0.01 N and about 1 N, or between about 0.01 N and about 0.5 N, or between about 0.1 N and about 30 N, or between about 0.1 N and about 20 N, or between about 0.1 N and about 10 N, or between about 0.1 N and about 6 N, or between about 0.1 N and about 2 N, or between about 0.1 N and about 1 N, or between about 0.1 N and about 0.5 N, or between about 0.5 N and about 30 N, or between about 0.5 N and about 20 N, or between about 0.5 N and about 10 N, or between about 0.5 N and about 6 N, or between about 0.5 N and about 2 N, or between about 0.5 N and about 1 N, or between about 1 N and about 30 N, or between about 1 N and about 20 N, or between about 1 N and about 10 N, or between about 1 N and about 6 N, or between about 1 N and about 2 N, or between about 2 N and about 30 N, or between about 2 N and about 20 N, or between about 2 N and about 10 N, or between about 2 N and about 6 N.

Examples of substrates include, but are not limited to, rigid materials, flexible and/or stretchable materials, silicones and other elastomers and other polymeric materials, metals (such as aluminum, copper, steel, stainless steel, etc.), adhesives, heat-sealable materials (such as cellulose, biaxially oriented polypropylene (BOPP), poly(lactic acid), polyurethanes, etc.), fabrics (including cloths) and textiles (such as cotton, wool, polyesters, rayon, etc.), clothing, leather, skin, glasses and other minerals, ceramics, silicon surfaces, wood, paper, cardboard, paperboard, cellulose-based materials, glassine, labels, silicon and other semiconductors, laminates, corrugated materials, concrete, bricks, fiber-reinforced materials (such as glass fiber reinforced materials, glass fiber-reinforced epoxy resins, fiberglass, etc.) and other building materials, etc. Substrates can in the form of films, papers, wafers, larger three-dimensional objects, etc. In some cases, the substrate(s) can be used as one or more of the conductive poles.

The substrates can have been treated with other coatings (such as paints) or similar materials before the poles applied. Examples include substrates (such as PET) coated with indium tin oxide, antimony tin oxide, etc. They can be woven, nonwoven, in mesh form; etc. They can be woven, nonwoven, in mesh form; etc.

The substrates can be paper-based materials generally (including paper, paperboard, cardboard, glassine, etc.). Paper-based materials can be surface treated or impregnated. Examples of surface treatments include coatings such as polymeric coatings, which can include PET, polyethylene, polypropylene, biaxially oriented polypropylene (BOPP), acetates, nitrocellulose, etc. Coatings can be adhesives. Paper based materials can be sized.

Examples of polymeric materials include, but are not limited to, those comprising thermoplastics and thermosets, including elastomers and rubbers (including thermoplastics and thermosets), phenolic resins, paper-reinforced phenolic resins, silicones, fluorinated polysiloxanes, natural rubber, butyl rubber, chlorosulfonated polyethylene, chlorinated polyethylene, styrene/butadiene copolymers (SBR), styrene/ethylene/butadiene/stryene copolymers (SEBS), styrene/ethylene/butadiene/stryene copolymers grafted with maleic anhydride, styrene/isoprene/styrene copolymers (SIS), polyisoprene, nitrile rubbers, hydrogenated nitrile rubbers, neoprene, ethylene/propylene copolymers (EPR), ethylene/propylene/diene copolymers (EPDM), ethylene/vinyl acetate copolymer (EVA), hexafluoropropylene/vinylidene fluoride/tetrafluoroethylene copolymers, tetrafluoroethylene/propylene copolymers, fluorelastomers, polyesters (such as poly (ethylene terephthalate), poly(butylene terephthalate), poly (ethylene naphthalate), liquid crystalline polyesters, poly (lactic acid), etc); polystyrene; polyamides (including polyterephthalamides); polyimides (such as Kapton®); aramids (such as Kevlar® and Nomex®); fluoropolymers (such as fluorinated ethylene propylene (FEP), polytetrafluoroethylene (PTFE), poly(vinyl fluoride), poly(vinylidene fluoride), etc.); polyetherimides; poly(vinyl chloride); poly(vinylidene chloride); polyurethanes (such as thermoplastic polyurethanes (TPU); spandex, cellulosic polymers (such as cellulose, nitrocellulose, cellulose acetate, etc.); styrene/acrylonitriles polymers (SAN); arcrylonitrile/butadiene/styrene polymers (ABS); polycarbonates; polyacrylates; poly(methyl methacrylate); ethylene/vinyl acetate copolymers; thermoset epoxies and polyurethanes; polyolefins (such as polyethylene (including low density polyethylene, high density polyethylene, ultrahigh molecular weight polyethylene, etc.), polypropylene (such as biaxially-oriented polypropylene, etc.); Mylar; etc. They can be non-woven materials, such as DuPont Tyvek®. They can be adhesive or adhesive-backed materials (such as adhesive-backed papers or paper substitutes). They can be mineral-based paper substitutes such as Teslin® from PPG Industries. The substrate can be a transparent or translucent or optical material, such as glass, quartz, polymer (such as polycarbonate or poly(meth)acrylates (such as poly(methyl methacrylate).

One or more poles can comprise at least one electrically conductive ink or coating. The compositions may be in the form of inks and coatings.

Examples of electrically conductive inks or coatings include those based on electrically conductive components such as metals, conductive polymers, graphene and other conductive carbon-based materials, etc.

Metals (including metal alloys), conductive metal oxides, conductive carbons, polymers, metal-coated materials, etc. These components can take a variety of forms, including particles, powders, flakes, foils, needles, etc.

Examples of metals include, but are not limited to silver, copper, aluminum, platinum, palladium, nickel, chromium, gold, zinc, tin, iron, gold, lead, steel, stainless steel, rhodium, titanium, tungsten, magnesium, brass, bronze, colloidal metals, etc. Examples of metal oxides include antimony tin oxide and indium tin oxide and materials such as fillers coated with metal oxides. Metal and metal-oxide coated materials include, but are not limited to metal coated carbon and graphite fibers, metal coated glass fibers, metal coated glass beads, metal coated ceramic materials (such as beads), etc. These materials can be coated with a variety of metals, including nickel.

Examples of electrically conductive polymers include, but are not limited to, polyacetylene, polyethylene dioxythiophene (PEDOT), poly(styrenesulfonate) (PSS), PEDOT:PSS copolymers, polythiophene and polythiophenes, poly (3-alkylthiophenes), poly(2,5-bis(3-tetradecylthiophen-2-yl)thieno[3,2-b]thiophene) (PBTTT), poly (phenylenevinylene), polypyrene, polycarbazole, polyazulene, polyazepine, polyflurorenes, polynaphthalene, polyisonaphthalene, polyaniline, polypyrrole, poly(phenylene sulfide), polycarbozoles, polyindoles, polyphenylenes, copolymers of one or more of the foregoing, etc., and their derivatives and copolymers. The conductive polymers may be doped or undoped. They may be doped with boron, phosphorous, iodine, etc.

Examples of conductive carbons include, but are not limited to, graphene and graphene sheets, graphite (including natural, Kish, and synthetic, annealed, pyrolytic, highly oriented pyrolytic, etc. graphites), graphitized carbon, carbon black, mesoporous carbon, carbon fibers and fibrils, carbon whiskers, vapor-grown carbon nanofibers, metal coated carbon fibers, carbon nanotubes (including single- and multi-walled nanotubes), fullerenes, activated carbon, carbon fibers, expanded graphite, expandable graphite, graphite oxide, hollow carbon spheres, carbon foams, etc.

By the terms "ink" and "coating" are meant composition that are in a form that is suitable for application to a substrate as well as the material after it is applied to the substrate, while it is being applied to the substrate, and both before and after any post-application treatments (such as evaporation, cross-linking, curing, etc.). The components of the ink and coating compositions may vary during these stages.

Inks and coating compositions used for the poles can have binders (such as polymer binders). Binders can be thermosets, thermoplastics, non-melt processible polymers, etc. Polymers can also comprise monomers that can be polymerized before, during, or after the application of the coating to the substrate. Polymeric binders can be crosslinked or otherwise cured after the coating has been applied to the substrate. Examples of polymers include, but are not limited to polyolefins (such as polyethylene, linear low density polyethylene (LLDPE), low density polyethylene (LDPE), high density polyethylene, polypropylene, and olefin copolymers), styrene/butadiene rubbers (SBR), styrene/ethylene/butadiene/styrene copolymers (SEBS), butyl rubbers, ethylene/propylene copolymers (EPR), ethylene/propylene/diene monomer copolymers (EPDM), polystyrene (including high impact polystyrene), poly(vinyl acetates), ethylene/vinyl acetate copolymers (EVA), poly(vinyl alcohols), ethylene/vinyl alcohol copolymers (EVOH), poly(vinyl butyral) (PVB), poly(vinyl formal), poly(methyl methacrylate) and other acrylate polymers and copolymers (such as methyl methacrylate polymers, methacrylate copolymers, polymers derived from one or more acrylates, methacrylates, ethyl acrylates, ethyl methacrylates, butyl acrylates, butyl methacrylates, glycidyl acrylates and methacrylates and the like), olefin and styrene copolymers, acrylonitrile/butadiene/styrene (ABS), styrene/acrylonitrile polymers (SAN), styrene/maleic anhydride copolymers, isobutylene/maleic anhydride copolymers, ethylene/acrylic acid copolymers, poly(acrylonitrile), poly(vinyl acetate) and poly(vinyl acetate) copolymers, poly(vinyl pyrrolidone) and poly(vinyl pyrrolidone) copolymers, vinyl acetate and vinyl pyrrolidone copolymers, polycarbonates (PC), polyamides, polyesters, liquid crystalline polymers (LCPs), poly(lactic acid) (PLA), poly (phenylene oxide) (PPO), PPO-polyamide alloys, polysulphone (PSU), polysulfides, polyetherketone (PEK), polyetheretherketone (PEEK), polyimides, polyoxymethylene (POM) homo- and copolymers, polyetherimides, fluorinated ethylene propylene polymers (FEP), poly(vinyl fluoride), poly(vinylidene fluoride), poly(vinylidene chloride), poly(vinyl chloride) (PVC), polyurethanes (thermoplastic and thermosetting (including crosslinked polyurethanes such as those crosslinked amines, etc.), aramides (such as Kevlar® and Nomex®), polysulfides, polytetrafluoroethylene (PTFE), polysiloxanes (including polydimethylenesiloxane, dimethylsiloxane/vinylmethylsiloxane copolymers, vinyldimethylsiloxane terminated poly(dimethylsiloxane), etc.), elastomers, epoxy polymers (including crosslinked epoxy polymers such as those crosslinked with polysulfones, amines, etc.), polyureas, alkyds, cellulosic polymers (such as nitrocellulose, ethyl cellulose, ethyl hydroxyethyl cellulose, carboxymethyl cellulose, cellulose acetate, cellulose acetate propionates, and cellulose acetate butyrates), polyethers (such as poly(ethylene oxide), poly(propylene oxide), poly(propylene glycol), oxide/propylene oxide copolymers, etc.), acrylic latex polymers, polyester acrylate oligomers and polymers, polyester diol diacrylate polymers, UV-curable resins, etc.

Examples of elastomers include, but are not limited to, polyurethanes, copolyetheresters, rubbers (including butyl rubbers and natural rubbers), styrene/butadiene copolymers, styrene/ethylene/butadiene/styrene copolymer (SEBS), polyisoprene, ethylene/propylene copolymers (EPR), ethylene/propylene/diene monomer copolymers (EPDM), polysiloxanes, and polyethers (such as poly(ethylene oxide), poly(propylene oxide), and their copolymers).

Examples of polyamides include, but are not limited to, aliphatic polyamides (such as polyamide 4,6; polyamide 6,6; polyamide 6; polyamide 11; polyamide 12; polyamide 6,9; polyamide 6,10; polyamide 6,12; polyamide 10,10; polyamide 10,12; and polyamide 12,12), alicyclic polyamides, and aromatic polyamides (such as poly(m-xylylene adipamide) (polyamide MXD,6)) and polyterephthalamides such as poly(dodecamethylene terephthalamide) (polyamide 12,T), poly(decamethylene terephthalamide) (polyamide 10,T), poly(nonamethylene terephthalamide) (polyamide 9,T), the polyamide of hexamethylene terephthalamide and hexamethylene adipamide, the polyamide of hexamethyleneterephthalamide, and 2-methylpentamethyleneterephthalamide), etc. The polyamides may be polymers and copolymers (i.e., polyamides having at least two different repeat units) having melting points between about 120 and 255° C. including aliphatic copolyamides having a melting point of about 230° C. or less, aliphatic copolyamides having a melting point of about 210° C. or less, aliphatic copolyamides having a melting point of about 200° C. or less, aliphatic copolyamides having a melting point of about 180° C. or less, etc. Examples of these include those sold under the trade names Macromelt by Henkel and Versamid by Cognis.

Examples of acrylate polymers include those made by the polymerization of one or more acrylic acids (including acrylic acid, methacrylic acid, etc.) and their derivatives, such as esters. Examples include methyl acrylate polymers, methyl methacrylate polymers, and methacrylate copolymers. Examples include polymers derived from one or more acrylates, methacrylates, acrylic acid, methacrylic acid, methyl acrylate, methyl methacrylate, ethyl acrylate, ethyl methacrylate, butyl acrylate, butyl methacrylate, glycidyl acrylate, glycidyl methacrylates, 2-ethylhexyl acrylate, 2-ethylhexyl methacrylate, hydroxyethyl acrylate, hydroxyethyl (meth)acrylate, acrylonitrile, and the like. The polymers may comprise repeat units derived from other monomers such as olefins (e.g. ethylene, propylene, etc.), vinyl acetates, vinyl alcohols, vinyl pyrrolidones, etc. They may include partially neutralized acrylate polymers and copolymers (such as ionomer resins).

Examples of polymers include Elvacite® polymers supplied by Lucite International, Inc., including Elvacite® 2009, 2010, 2013, 2014, 2016, 2028, 2042, 2045, 2046, 2550, 2552, 2614, 2669, 2697, 2776, 2823, 2895, 2927, 3001, 3003, 3004, 4018, 4021, 4026, 4028, 4044, 4059, 4400, 4075, 4060, 4102, etc. Other polymer families include Bynel® polymers (such as Bynel® 2022 supplied by DuPont) and Joncryl® polymers (such as Joncryl® 678 and 682).

Examples of polyesters include, but are not limited to, poly(butylene terephthalate) (PBT), poly(ethylene terephthalate) (PET), poly(1,3-propylene terephthalate) (PPT), poly(ethylene naphthalate) (PEN), poly(cyclohexanedimethanol terephthalate) (PCT)), etc.

In some embodiment, the polymer has a acid number of at least about 5, or at least about 10, or at least about 15, or at least about 20.

In some embodiments, the glass transition temperature of at least one polymer is no greater than about 100° C., 90° C., or no greater than about 80° C., or no greater than about 70° C., or no greater than about 60° C., or no greater than about 50° C., or no greater than about 40° C.

In some cases, when a binder is used, it can be present relative to the electrically conductive components in from about 1 to about 99 weight percent, or from about 1 to about 50 weight percent, or from about 1 to about 30 weight percent, or from about 1 to about 20 weight percent, or from about 5 to about 80 weight percent, or from about 5 to about 60 weight percent, or from about 5 to about 30 weight percent, or from about 15 to about 85 weight percent, or from about 15 to about 60 weight percent, or from about 15 to about 30 weight percent, or from about 25 to about 80 weight percent, or from about 25 to about 50 weight percent, or from about 40 to about 90 weight percent, or from about 50 to about 90 weight percent, or from about 70 to about 95 weight percent, based on the total weight of binder and electrically conductive component.

Inks and coating compositions used for the poles and variable resistance materials can contain additives such as dispersion aids (including surfactants, emulsifiers, and wetting aids), adhesion promoters, thickening agents (including clays), defoamers and antifoamers, biocides, additional fillers, flow enhancers, stabilizers, crosslinking and curing agents, conductive additives, etc.

Examples of dispersing aids include glycol ethers (such as poly(ethylene oxide), block copolymers derived from ethylene oxide and propylene oxide (such as those sold under the trade name Pluronic® by BASF), acetylenic diols (such as 2,5,8,11-tetramethyl-6-dodecyn-5,8-diol ethoxylate and others sold by Air Products under the trade names Surfynol® and Dynol®), salts of carboxylic acids (including alkali metal and ammonium salts), and polysiloxanes.

Examples of grinding aids include stearates (such as Al, Ca, Mg, and Zn stearates) and acetylenic diols (such as those sold by Air Products under the trade names Surfynol® and Dynol®).

Examples of adhesion promoters include titanium chelates and other titanium compounds such as titanium phosphate complexes (including butyl titanium phosphate), titanate esters, diisopropoxy titanium bis(ethyl-3-oxobutanoate, isopropoxy titanium acetylacetonate, and others sold by Johnson-Matthey Catalysts under the trade name Vertec.

Examples of thickening agents include glycol ethers (such as poly(ethylene oxide), block copolymers derived from ethylene oxide and propylene oxide (such as those sold under the trade name Pluronic® by BASF), long-chain carboxylate salts (such aluminum, calcium, zinc, etc. salts of stearates, oleats, palmitates, etc.), aluminosilicates (such as those sold under the Minex® name by Unimin Specialty Minerals and Aerosil® 9200 by Evonik Degussa), fumed silica, natural and synthetic zeolites, etc.

The compositions may optionally comprise at least one "multi-chain lipid", by which term is meant a naturally-occurring or synthetic lipid having a polar head group and at least two nonpolar tail groups connected thereto. Examples of polar head groups include oxygen-, sulfur-, and halogen-containing, phosphates, amides, ammonium groups, amino acids (including α-amino acids), saccharides, polysaccharides, esters (Including glyceryl esters), zwitterionic groups, etc.

The tail groups may be the same or different. Examples of tail groups include alkanes, alkenes, alkynes, aromatic compounds, etc. They may be hydrocarbons, functionalized hydrocarbons, etc. The tail groups may be saturated or unsaturated. They may be linear or branched. The tail groups may be derived from fatty acids, such as oleic acid, palmitic acid, stearic acid, arachidic acid, erucic acid, arachadonic acid, linoleic acid, linolenic acid, oleic acid, etc.

Examples of multi-chain lipids include, but are not limited to, lecithin and other phospholipids (such as phosphatidylcholine, phosphoglycerides (including phosphatidylserine, phosphatidylinositol, phosphatidylethanolamine (cephalin), and phosphatidylglycerol) and sphingomyelin); glycolipids (such as glucosyl-cerebroside); saccharolipids; sphingolipids (such as ceramides, di- and triglycerides, phosphosphingolipids, and glycosphingolipids); etc. They may be amphoteric, including zwitterionic.

The inks and coatings compositions can comprise of solvents such as water, distilled or synthetic isoparaffinic hydrocarbons (such Isopar® and Norpar® (both manufactured by Exxon) and Dowanol® (manufactured by Dow), citrus terpenes and mixtures containing citrus terpenes (such as Purogen, Electron, and Positron (all manufactured by Ecolink)), terpenes and terpene alcohols (including terpineols, including alpha-terpineol), limonene, aliphatic petroleum distillates, alcohols (such as methanol, ethanol, n-propanol, i-propanol, n-butanol, i-butanol, sec-butanol, tert-butanol, pentanols, i-amyl alcohol, hexanols, heptanols, octanols, diacetone alcohol, butyl glycol, etc.), ketones (such as acetone, methyl ethyl ketone, cyclohexanone, i-butyl ketone, 2,6,8,trimethyl-4-nonanone etc.), esters (such as methyl acetate, ethyl acetate, n-propyl acetate, i-propyl acetate, n-butyl acetate, i-butyl acetate, tert-butyl acetate, carbitol acetate, etc.), glycol ethers, ester and alcohols (such as 2-(2-ethoxyethoxy)ethanol, propylene glycol monomethyl ether and other propylene glycol ethers; ethylene glycol monobutyl ether, 2-methoxyethyl ether (diglyme), propylene glycol methyl ether (PGME); and other ethylene glycol ethers; ethylene and propylene glycol ether acetates, diethylene glycol monoethyl ether acetate, 1-methoxy-2-propanol acetate (PGMEA); and hexylene glycol (such as Hexasol™ (supplied by SpecialChem)), dibasic esters (such as dimethyl succinate, dimethyl glutarate, dimethyl adipate), dimethylsulfoxide (DMSO), 1,3-dimethyl-3,4,5,6-tetrahydro-2(1H)-pyrimidinone (DMPU), imides, amides (such as dimethylformamide (DMF), dimethylacetamide, etc.), cyclic amides (such as N-methylpyrrolidone and 2-pyrrolidone), lactones (such as beta-propiolactone, gamma-valerolactone, delta-valerolactone, gamma-butyrolactone, epsilon-caprolactone), cyclic imides (such as imidazolidinones such as N,N'-dimethylimidazolidinone (1,3-dimethyl-2-imidazolidinone)), aromatic solvents and aromatic solvent mixtures (such as toluene, xylenes, mesitylene, cumene, etc.), petroleum distillates, naphthas (such as VM&P naphtha), and and mixtures of two or more of the foregoing and mixtures of one or more of the foregoing with other carriers. Solvents can be low- or non-VOC solvents, non-hazardous air pollution solvents, and non-halogenated solvents.

Electrically conductive inks and coatings compositions can comprise graphene sheets. Graphene sheets are graphite sheets preferably having a surface area of from about 100 to about 2630 $m^2/g$. In some embodiments, the graphene sheets primarily, almost completely, or completely comprise fully exfoliated single sheets of graphite (these are approximately ≤1 nm thick and are often referred to as "graphene"), while in other embodiments, at least a portion of the graphene sheets may comprise partially exfoliated graphite sheets, in which two or more sheets of graphite have not been exfoliated from each other. The graphene sheets may comprise mixtures of fully and partially exfoliated graphite sheets. Graphene sheets are distinct from carbon nanotubes. Graphene sheets may have a "platey" (e.g. two-dimensional) structure and do not have the needle-like form of carbon nanotubes. The two longest dimensions of the graphene sheets may each be at least about 10 times greater, or at least about 50 times greater, or at least about 100 times greater, or at least about 1000 times greater, or at least about 5000 times greater, or at least about 10,000 times greater than the shortest dimension (i.e. thickness) of the sheets.

Graphene sheets are distinct from expanded, exfoliated, vermicular, etc. graphite, which has a layered or stacked structure in which the layers are not separated from each other. The graphene sheets do not need to be entirely made up of carbon, but can have heteroatoms incorporated into the lattice or as part of functional groups attached to the lattice. The lattice need not be a perfect hexagonal lattice and may contain defects (including five- and seven-membered rings).

Graphene sheets may be made using any suitable method. For example, they may be obtained from graphite, graphite oxide, expandable graphite, expanded graphite, etc. They may be obtained by the physical exfoliation of graphite, by for example, peeling, grinding, milling, graphene sheets. They made be made by sonication of precursors such as graphite. They may be made by opening carbon nanotubes. They may be made from inorganic precursors, such as silicon carbide. They may be made by chemical vapor deposition (such as by reacting a methane and hydrogen on a metal surface). They may be made by epitaxial growth on substrates such as silicon carbide and metal substrates and by growth from metal-carbon melts. They made by made They may be made by the reduction of an alcohol, such ethanol, with a metal (such as an alkali metal like sodium) and the subsequent pyrolysis of the alkoxide product (such a method is reported in *Nature Nanotechnology* (2009), 4, 30-33). They may be made from small molecule precursors such as carbon dioxide, alcohols (such as ethanol, methanol, etc.), alkoxides (such as ethoxides, methoxides, etc., including sodium, potassium, and other alkoxides). They may be made by the exfoliation of graphite in dispersions or exfoliation of graphite oxide in dispersions and the subsequently reducing the exfoliated graphite oxide. Graphene sheets may be made by the exfoliation of expandable graphite, followed by intercalation, and ultrasonication or other means of separating the intercalated sheets (see, for example, *Nature Nanotechnology* (2008), 3, 538-542). They may be made by the intercalation of graphite and the subsequent exfoliation of the product in suspension, thermally, etc. Exfoliation processes may be thermal, and include exfoliation by rapid heating, using microwaves, furnaces, hot baths, etc.

Graphene sheets may be made from graphite oxide (also known as graphitic acid or graphene oxide). Graphite may be treated with oxidizing and/or intercalating agents and exfoliated. Graphite may also be treated with intercalating agents and electrochemically oxidized and exfoliated. Graphene sheets may be formed by ultrasonically exfoliating suspensions of graphite and/or graphite oxide in a liquid (which may contain surfactants and/or intercalants). Exfoliated graphite oxide dispersions or suspensions can be subsequently reduced to graphene sheets. Graphene sheets may also be formed by mechanical treatment (such as grinding or milling) to exfoliate graphite or graphite oxide (which would subsequently be reduced to graphene sheets).

Graphene sheets may be made by the reduction of graphite oxide. Reduction of graphite oxide to graphene may be done by thermal reduction/annealing, chemical reduction, etc. and may be carried out on graphite oxide in a solid form, in a dispersion, etc. Examples of useful chemical reducing agents include, but are not limited to, hydrazines (such as hydrazine (in liquid or vapor forms, N,N-dimethylhydrazine, etc.), sodium borohydride, citric acid, hydroquinone, isocyanates (such as phenyl isocyanate), hydrogen, hydrogen plasma, etc. A dispersion or suspension of exfoliated graphite oxide in a carrier (such as water, organic solvents, or a mixture of solvents) can be made using any suitable method (such as ultrasonication and/or mechanical grinding or milling) and reduced to graphene sheets. Reduction can be solvothermal reduction, in solvents such as water, ethanol, etc. This can for example be done in an autoclave at elevated temperatures (such as those above about 200° C.).

Graphite oxide may be produced by any method known in the art, such as by a process that involves oxidation of graphite using one or more chemical oxidizing agents and, optionally, intercalating agents such as sulfuric acid. Examples of oxidizing agents include nitric acid, nitrates (such as sodium and potassium nitrates), perchlorates, potassium chlorate, sodium chlorate, chromic acid, potassium chromate, sodium chromate, potassium dichromate, sodium dichromate, hydrogen peroxide, sodium and potassium permanganates, phosphoric acid ($H_3PO_4$), phosphorus pentoxide, bisulfites, etc. Preferred oxidants include $KClO_4$; $HNO_3$ and $KClO_3$; $KMnO_4$ and/or $NaMnO_4$; $KMnO_4$ and $NaNO_3$; $K_2S_2O_8$ and $P_2O_5$ and $KMnO_4$; $KMnO_4$ and $HNO_3$; and $HNO_3$. Preferred intercalation agents include sulfuric acid. Graphite may also be treated with intercalating agents and electrochemically oxidized. Examples of methods of making graphite oxide include those described by Staudenmaier (*Ber. Stsch. Chem. Ges.* (1898), 31, 1481) and Hummers (*J. Am. Chem. Soc.* (1958), 80, 1339).

One example of a method for the preparation of graphene sheets is to oxidize graphite to graphite oxide, which is then thermally exfoliated to form graphene sheets (also known as thermally exfoliated graphite oxide), as described in US 2007/0092432, the disclosure of which is hereby incorporated herein by reference. The thusly formed graphene sheets may display little or no signature corresponding to graphite or graphite oxide in their X-ray diffraction pattern.

The thermal exfoliation may be carried out in a continuous, semi-continuous batch, etc. process.

Heating can be done in a batch process or a continuous process and can be done under a variety of atmospheres, including inert and reducing atmospheres (such as nitrogen, argon, and/or hydrogen atmospheres). Heating times can range from under a few seconds or several hours or more, depending on the temperatures used and the characteristics desired in the final thermally exfoliated graphite oxide. Heating can be done in any appropriate vessel, such as a fused silica, mineral, metal, carbon (such as graphite), ceramic, etc. vessel. Heating may be done using a flash lamp or with microwave. During heating, the graphite oxide may be contained in an essentially constant location in single batch reaction vessel, or may be transported through one or more vessels during the reaction in a continuous or batch mode. Heating may be done using any suitable means, including the use of furnaces and infrared heaters.

Examples of temperatures at which the thermal exfoliation and/or reduction of graphite oxide can be carried out are at least about 150° C., at least about 200° C., at least about 300° C., at least about 400° C., at least about 450° C., at least about 500° C., at least about 600° C., at least about 700° C., at least about 750° C., at least about 800° C., at least about 850° C., at least about 900° C., at least about 950° C., at least about 1000° C., at least about 1100° C., at least about 1500° C., at least about 2000° C., and at least about 2500° C. Preferred ranges include between about 750 about and 3000° C., between about 850 and 2500° C., between about 950 and about 2500° C., between about 950 and about 1500° C., between about 750 about and 3100° C., between about 850 and 2500° C., or between about 950 and about 2500° C.

The time of heating can range from less than a second to many minutes. For example, the time of heating can be less than about 0.5 seconds, less than about 1 second, less than about 5 seconds, less than about 10 seconds, less than about 20 seconds, less than about 30 seconds, or less than about 1 min. The time of heating can be at least about 1 minute, at least about 2 minutes, at least about 5 minutes, at least about 15 minutes, at least about 30 minutes, at least about 45 minutes, at least about 60 minutes, at least about 90 minutes, at least about 120 minutes, at least about 150 minutes, at least about 240 minutes, from about 0.01 seconds to about 240 minutes, from about 0.5 seconds to about 240 minutes, from about 1 second to about 240 minutes, from about 1 minute to about 240 minutes, from about 0.01 seconds to about 60 minutes, from about 0.5 seconds to about 60 minutes, from about 1 second to about 60 minutes, from about 1 minute to about 60 minutes, from about 0.01 seconds to about 10 minutes, from about 0.5 seconds to about 10 minutes, from about 1 second to about 10 minutes, from about 1 minute to about 10 minutes, from about 0.01 seconds to about 1 minute, from about 0.5 seconds to about 1 minute, from about 1 second to about 1 minute, no more than about 600 minutes, no more than about 450 minutes, no more than about 300 minutes, no more than about 180 minutes, no more than about 120 minutes, no more than about 90 minutes, no more than about 60 minutes, no more than about 30 minutes, no more than about 15 minutes, no more than about 10 minutes, no more than about 5 minutes, no more than about 1 minute, no more than about 30 seconds, no more than about 10 seconds, or no more than about 1 second. During the course of heating, the temperature may vary.

Examples of the rate of heating include at least about 120° C./min, at least about 200° C./min, at least about 300° C./min, at least about 400° C./min, at least about 600° C./min, at least about 800° C./min, at least about 1000° C./min, at least about 1200° C./min, at least about 1500° C./min, at least about 1800° C./min, and at least about 2000° C./min.

Graphene sheets may be annealed or reduced to graphene sheets having higher carbon to oxygen ratios by heating under reducing atmospheric conditions (e.g., in systems purged with inert gases or hydrogen). Reduction/annealing temperatures are preferably at least about 300° C., or at least about 350° C., or at least about 400° C., or at least about 500° C., or at least about 600° C., or at least about 750° C., or at least about 850° C., or at least about 950° C., or at least about 1000° C. The temperature used may be, for example, between about 750 about and 3000° C., or between about 850 and 2500° C., or between about 950 and about 2500° C.

The time of heating can be for example, at least about 1 second, or at least about 10 second, or at least about 1 minute, or at least about 2 minutes, or at least about 5 minutes. In some embodiments, the heating time will be at least about 15 minutes, or about 30 minutes, or about 45 minutes, or about 60 minutes, or about 90 minutes, or about 120 minutes, or about 150 minutes. During the course of annealing/reduction, the temperature may vary within these ranges.

The heating may be done under a variety of conditions, including in an inert atmosphere (such as argon or nitrogen) or a reducing atmosphere, such as hydrogen (including hydrogen diluted in an inert gas such as argon or nitrogen), or under vacuum. The heating may be done in any appropriate vessel, such as a fused silica or a mineral or ceramic vessel or a metal vessel. The materials being heated including any starting materials and any products or intermediates) may be contained in an essentially constant location in single batch reaction vessel, or may be transported through one or more vessels during the reaction in a continuous or batch reaction. Heating may be done using any suitable means, including the use of furnaces and infrared heaters.

The graphene sheets preferably have a surface area of at least about 100 $m^2/g$ to, or of at least about 200 $m^2/g$, or of at least about 300 $m^2/g$, or of least about 350 $m^2/g$, or of least about 400 $m^2/g$, or of least about 500 $m^2/g$, or of least about 600 $m^2/g$, or of least about 700 $m^2/g$, or of least about 800 $m^2/g$, or of least about 900 $m^2/g$, or of least about 700 $m^2/g$. The surface area may be about 400 to about 1100 $m^2/g$. The theoretical maximum surface area can be calculated to be 2630 $m^2/g$. The surface area includes all values and subvalues therebetween, especially including 400, 500, 600, 700, 800, 900, 1000, 1100, 1200, 1300, 1400, 1500, 1600, 1700, 1800, 1900, 2000, 2100, 2200, 2300, 2400, 2500, and 2630 $m^2/g$.

The graphene sheets can have number average aspect ratios of about 100 to about 100,000, or of about 100 to about 50,000, or of about 100 to about 25,000, or of about 100 to about 10,000 (where "aspect ratio" is defined as the ratio of the longest dimension of the sheet to the shortest).

Surface area can be measured using either the nitrogen adsorption/BET method at 77 K or a methylene blue (MB) dye method in liquid solution.

The dye method is carried out as follows: A known amount of graphene sheets is added to a flask. At least 1.5 g of MB are then added to the flask per gram of graphene sheets. Ethanol is added to the flask and the mixture is ultrasonicated for about fifteen minutes. The ethanol is then evaporated and a known quantity of water is added to the flask to re-dissolve the free MB. The undissolved material is allowed to settle, preferably by centrifuging the sample. The concentration of MB in solution is determined using a UV-vis spectrophotometer by measuring the absorption at $\lambda_{max}$=298 nm relative to that of standard concentrations.

The difference between the amount of MB that was initially added and the amount present in solution as determined by UV-vis spectrophotometry is assumed to be the amount of MB that has been adsorbed onto the surface of the graphene sheets. The surface area of the graphene sheets are then calculated using a value of 2.54 $m^2$ of surface covered per one mg of MB adsorbed.

The graphene sheets may have a bulk density of from about 0.01 to at least about 200 $kg/m^3$. The bulk density includes all values and subvalues therebetween, especially including 0.05, 0.1, 0.5, 1, 5, 10, 15, 20, 25, 30, 35, 50, 75, 100, 125, 150, and 175 $kg/m^3$.

The graphene sheets may be functionalized with, for example, oxygen-containing functional groups (including, for example, hydroxyl, carboxyl, and epoxy groups) and typically have an overall carbon to oxygen molar ratio (C/O ratio), as determined by bulk elemental analysis, of at least about 1:1, or more preferably, at least about 3:2. Examples of carbon to oxygen ratios include about 3:2 to about 85:15; about 3:2 to about 20:1; about 3:2 to about 30:1; about 3:2 to about 40:1; about 3:2 to about 60:1; about 3:2 to about 80:1; about 3:2 to about 100:1; about 3:2 to about 200:1; about 3:2 to about 500:1; about 3:2 to about 1000:1; about 3:2 to greater than 1000:1; about 10:1 to about 30:1; about 80:1 to about 100:1; about 20:1 to about 100:1; about 20:1 to about 500:1; about 20:1 to about 1000:1; about 50:1 to about 300:1; about 50:1 to about 500:1; and about 50:1 to about 1000:1. In some embodiments, the carbon to oxygen ratio is at least about 10:1, or at least about 15:1, or at least about 20:1, or at least about 35:1, or at least about 50:1, or at least about 75:1, or at least about 100:1, or at least about 200:1, or at least about 300:1, or at least about 400:1, or at least 500:1, or at least about 750:1, or at least about 1000:1; or at least about 1500:1, or at least about 2000:1. The carbon to oxygen ratio also includes all values and subvalues between these ranges.

The graphene sheets may contain atomic scale kinks. These kinks may be caused by the presence of lattice defects in, or by chemical functionalization of the two-dimensional hexagonal lattice structure of the graphite basal plane.

Compositions comprising graphene sheets may further comprise graphite (including natural, Kish, and synthetic, annealed, pyrolytic, highly oriented pyrolytic, etc. graphites). In some cases, the graphite can be present in from about 1 to about 99 percent, or from about 10 to about 99 percent, or from about 20 to about 99 percent, from about 30 to about 99 percent, or from about 40 to about 99 percent, or from about 50 to about 99 percent, or from about 60 to about 99 percent, or from about 70 to about 99 percent, or from about 80 to about 99 percent, or from about 85 to about 99 percent, or from about 90 to about 99 percent, or from about 1 to about 95 percent, or from about 10 to about 95 percent, or from about 20 to about 95 percent, from about 30 to about 95 percent, or from about 40 to about 95 percent, or from about 50 to about 95 percent, or from about 60 to about 95 percent, or from about 70 to about 95 percent, or from about 80 to about 95 percent, or from about 85 to about 95 percent, or from about 90 to about 95 percent, or from about 1 to about 80 percent, or from about 10 to about 80 percent, or from about 20 to about 80 percent, from about 30 to about 80 percent, or from about 40 to about 80 percent, or from about 50 to about 80 percent, or from about 60 to about 80 percent, or from about 70 to about 80 percent, or from about 1 to about 70 percent, or from about 10 to about 70 percent, or from about 20 to about 70 percent, from about 30 to about 70 percent, or from about 40 to about 70 percent, or from about 50 to about 70 percent, or from about 60 to about 70 percent, or from about 1 to about 60 percent, or from about 10 to about 60 percent, or from about 20 to about 60 percent, from about 30 to about 60 percent, or from about 40 to about 60 percent, or from about 50 to about 60 percent, or from about 1 to about 50 percent, or from about 10 to about 50 percent, or from about 20 to about 50 percent, from about 30 to about 50 percent, or from about 40 to about 50 percent, or from about 1 to about 40 percent, or from about 10 to about 40 percent, or from about 20 to about 40 percent, from about 30 to about 40 percent, from about 1 to about 30 percent, or from about 10 to about 30 percent, or from about 20 to about 30 percent, or from about 1 to about 20 percent, or from about 10 to about 20 percent, or from about 1 to about 10 percent, based on the total weight of graphene sheets and graphite.

The graphene sheets may comprise two or more graphene powders having different particle size distributions and/or morphologies. The graphite may also comprise two or more graphite powders having different particle size distributions and/or morphologies.

Inks and coatings compositions can be formed by blending the components (such as, depending on the ink or coating use and composition, one or more of the low Tg polymer, conductive additives, solvents, binders, other additives etc.). Blending can be done for example using solution/dispersion blending. The compositions may be made using any suitable method, including wet or dry methods and batch, semi-continuous, and continuous methods. Dispersions, suspensions, solutions, etc. of conductive components (such as graphene sheets) and/or other components can be made or processed (e.g., milled/ground, blended, dispersed, suspended, etc.) by using suitable mixing, dispersing, and/or compounding techniques.

For example, components of the inks and coatings may be processed (e.g., milled/ground, blended, etc. by using suitable mixing, dispersing, and/or compounding techniques and apparatus, including ultrasonic devices, high-shear mixers, ball mills, attrition equipment, sandmills, two-roll mills, three-roll mills, cryogenic grinding crushers, extruders, kneaders, double planetary mixers, triple planetary mixers, high pressure homogenizers, horizontal and vertical wet grinding mills, etc.) Processing (including grinding) technologies can be wet or dry and can be continuous or discontinuous. Suitable materials for use as grinding media include metals, carbon steel, stainless steel, ceramics, stabilized ceramic media (such as cerium yttrium stabilized zirconium oxide), PTFE, glass, tungsten carbide, etc. Methods such as these can be used to change the particle size and/or morphology of components such as conductive components (including carbon components, graphite, graphene sheets, metal particles, etc.)

Components may be processed together or separately and may go through multiple processing (including mixing/blending) stages, each involving one or more components (including blends).

After blending and/or grinding steps, additional components may be added to the compositions, including, but not limited to, thickeners, viscosity modifiers, binders, etc. The compositions may also be diluted by the addition of more carrier.

Inks and coatings may be applied using any suitable method, including, but not limited to, painting, pouring, spin casting, solution casting, dip coating, powder coating, by syringe or pipette, spray coating, curtain coating, lamination, co-extrusion, electrospray deposition, ink-jet printing, spin coating, thermal transfer (including laser transfer) methods, doctor blade printing, screen printing, rotary screen printing, gravure printing, lithographic printing, intaglio printing, digital printing, capillary printing, offset printing, electrohydrodynamic (EHD) printing (a method of which is described in WO 2007/053621, which is hereby incorporated herein by reference), microprinting, pad printing, tampon printing, stencil printing, wire rod coating, drawing, flexographic printing, stamping, xerography, microcontact printing, dip pen nanolithography, laser printing, via pen, brush, sponge, or similar means, etc. The compositions can be applied in multiple layers.

After they have been applied to a substrate, the inks and coatings may be cured using any suitable technique, including drying and oven-drying (in air or another inert or reactive atmosphere), UV curing, IR curing, drying, cross-linking, thermal curing, laser curing, IR curing, microwave curing or drying, sintering, and the like.

In some cases, the electrical poles can have a conductivity of at least about $10^{-8}$ S/m. They can have a conductivity of about $10^{-6}$ S/m to about $10^{5}$ S/m, or of about $10^{-5}$ S/m to about $10^{5}$ S/m. In other embodiments of the invention, the coating has conductivities of at least about 0.001 S/m, of at least about 0.01 S/m, of at least about 0.1 S/m, of at least about 1 S/m, of at least about 10 S/m, of at least about 100 S/m, or at least about 1000 S/m, or at least about 10,000 S/m, or at least about 20,000 S/m, or at least about 30,000 S/m, or at least about 40,000 S/m, or at least about 50,000 S/m, or at least about 60,000 S/m, or at least about 75,000 S/m, or at least about $10^{5}$ S/m, or at least about $10^{6}$ S/m.

In some embodiments, the surface resistivity of the electrical poles can be no greater than about 10000 Ω/square/mil, or no greater than about 5000 Ω/square/mil, or no greater than about 1000 Ω/square/mil or no greater than about 700 Ω/square/mil, or no greater than about 500 Ω/square/mil, or no greater than about 350 Ω/square/mil, or no greater than about 200 Ω/square/mil, or no greater than about 200 Ω/square/mil, or no greater than about 150 Ω/square/mil, or no greater than about 100 Ω/square/mil, or no greater than about 75 Ω/square/mil, or no greater than about 50 Ω/square/mil, or no greater than about 30 Ω/square/mil, or no greater than about 20 Ω/square/mil, or no greater than about 10 Ω/square/mil, or no greater than about 5 Ω/square/mil, or no greater than about 1 Ω/square/mil, or no greater than about 0.1 Ω/square/mil, or no greater than about 0.01 Ω/square/mil, or no greater than about 0.001 Ω/square/mil.

The switches or sensors can be used in rigid or flexible (such as those that can be rolled, folded, bent, etc.) devices. They can be used in appliances (such as microwave ovens, ovens, refrigerators, washing machines and dryers, dishwashers, etc.), point-of-sale devices (such as fuel pumps, cash registers, credit card readers, etc.), electronic devices (such as computers, laptop computers, cellular telephones, personal digital assistants, tablet computers (e.g. iPads, Kindles, etc.), GPS devices, music players, calculators, gaming systems (such as consoles, game boards, controllers, or ancillaries), peripherals (e.g., fax machines, scanners, printers, etc.), DVD and other video players, audio and stereo equipment, cameras, etc.), medical devices (including monitoring devices, portable monitoring devices (such as insulin pumps, glucose meters, heart rate meters, etc.)), automobiles and other vehicles (such as in displays, controls, door and dashboard controls, key fobs, etc.), military equipment and devices (such as detonator switches or sensors etc.), oil and gas discovery and production equipment and devices (deep-sea and down-hole switches or sensors), packaging materials (to detect contact or tampering etc.) construction and farm equipment, air and space travel vehicles, musical instruments, etc. The switch or sensor can be used in screens, keyboards, pointing devices, etc. The technology can be used as impact, force, weight or pressure switches or sensors (e.g., seat occupancy sensors, box-stacking prevention sensors, security/intrusion detection sensors, item-removal detection sensors (for anti-theft and/or inventory control), aerodynamic or hydrodynamic force/pressure profile detection sensors. The technology can be applied to clothing and fabrics for wearable electronics, control switches and sensors. The switches and sensors can be fully encapsulated or laminated, leaving no air gaps to form thin, rollable, foldable, and/or water-proof devices. Force and pressure sensors can be used for large area applications (e.g. smart boards, floors, walls, etc.) in which the location of the contact is detected within a large area (e.g. a coated area).

In some cases the switches or sensors can be used where typical membrane switches or sensors having a movable contact would be used.

The invention claimed is:

1. An electrical switch or sensor, comprising:

a first electrical pole;

a layer of a variable resistance material in electrical contact with the first electrical pole;

a second electrical pole that is in electrical contact with the variable resistance material and is not in electrical contact with the first pole;

wherein the variable resistance material comprises at least one polymer having a glass transition temperature of no higher than about 10° C.;

wherein one or both of the first electrical pole and the second electrical pole comprise an electrically conductive ink or coating: and wherein the electrically conductive ink or coating comprises substantially flat graphene sheets.

2. The switch or sensor of claim 1, wherein the polymer has a glass transition temperature that is no higher than about 0° C.

3. The switch or sensor of claim 1, wherein the polymer has a glass transition temperature that is no higher than about −10° C.

4. The switch or sensor of claim 1, wherein the polymer has a glass transition temperature that is no higher than about −20° C.

5. The switch or sensor of claim 1, wherein the polymer comprises an acrylate polymer.

6. The switch or sensor of claim 1, wherein the polymer comprises a pressure sensitive adhesive.

7. The switch or sensor of claim 1, wherein the variable resistance material is printed or coated.

8. The switch or sensor of claim 1, wherein the variable resistance material further comprises at least one electrically conductive component.

9. The switch or sensor of claim 8, wherein the variable resistance material comprises graphene sheets.

10. The switch or sensor of claim 1, wherein the graphene sheets have a surface area of at least about 300 $m^2/g$.

11. The switch or sensor of claim 1, wherein the electrical conductive ink or coating has a surface resistivity of no greater than about 30 Ω/square/mil.

12. The switch or sensor of claim 1, wherein the electrical resistance between the first and second poles is at least about 100 MΩ.

13. The switch or sensor of claim 1, wherein the variable resistance layer has a thickness of between about 1 micron and 500 microns.

14. A method of activating a switch or sensor, comprising applying sufficient pressure to a switch or sensor comprising:

a first electrical pole;

a layer of a variable resistance material in electrical contact with the first electrical pole;

a second electrical pole that is in electrical contact with the variable resistance material and is not in electrical contact with the first pole, such that the electrical resistance between the first and second electrical poles is no more than about 500 kΩ after applying pressure;

wherein the variable resistance material comprises at least one polymer having a glass transition temperature of no higher than about 10° C.;

wherein one or both of the first electrical pole and the second electrical pole comprise an electrically conductive ink or coating; and wherein the electrically conductive ink or coating comprises substantially flat graphene sheets.

15. The method of claim 14, wherein the pressure is at least about 0.1 N.

16. The method of claim 14, wherein the electrical resistance between the first and second poles decreases by a factor of at least about 1,000 to about 10,000,000 after pressure is applied to the switch or circuit.

17. The method of claim 14, wherein the polymer has a glass transition temperature that is no higher than about −10° C.

* * * * *